US010364734B2

(12) United States Patent
Sahan et al.

(10) Patent No.: US 10,364,734 B2
(45) Date of Patent: Jul. 30, 2019

(54) ASSEMBLY FOR AN EXHAUST SYSTEM

(71) Applicant: FRIEDRICH BOYSEN GMBH & CO. KG, Altensteig (DE)

(72) Inventors: Ramazan Sahan, Pfalzgrafenweiler (DE); Andreas Roller, Freudenstadt (DE); Volkmar Knipps, Haiterbach (DE)

(73) Assignee: Friedrich Boysen GMBH & Co. KG, Altensteig (DE)

( * ) Notice: Subject to any disclaimer, the term of this patent is extended or adjusted under 35 U.S.C. 154(b) by 70 days.

(21) Appl. No.: 15/667,332

(22) Filed: Aug. 2, 2017

(65) Prior Publication Data

US 2018/0038263 A1 Feb. 8, 2018

(30) Foreign Application Priority Data

Aug. 3, 2016 (DE) ..... 10 2016 114 317

(51) Int. Cl.
*F01N 13/00* (2010.01)
*F01N 13/18* (2010.01)
*F01N 1/08* (2006.01)

(52) U.S. Cl.
CPC ..... *F01N 13/1805* (2013.01); *F01N 1/084* (2013.01); *F01N 1/089* (2013.01); *F01N 13/00* (2013.01); *F01N 13/1827* (2013.01); *F01N 13/1838* (2013.01); *F01N 13/1844* (2013.01); *F01N 2450/22* (2013.01)

(58) Field of Classification Search
CPC ..... F01N 13/1805; F01N 13/1827; F01N 13/1838; F01N 13/1844; F01N 2450/22
See application file for complete search history.

(56) References Cited

U.S. PATENT DOCUMENTS 7,934,583 B2 5/2011 Reuther et al.
8,985,272 B1 * 3/2015 Yoshida ..... F01N 3/2885 181/282
2005/0023076 A1 * 2/2005 Huff ..... B60R 19/48 181/246
2007/0240932 A1 * 10/2007 Van De Flier ..... B60K 13/04 181/228
2009/0194364 A1 * 8/2009 Leboeuf ..... F01N 1/24 181/247
2011/0272209 A1 11/2011 Tauschek et al.
2012/0273300 A1 * 11/2012 Jones ..... F01N 1/006 181/228
2012/0273301 A1 * 11/2012 Jones ..... F01N 1/006 181/228
2015/0053501 A1 2/2015 Carr et al.

FOREIGN PATENT DOCUMENTS

DE 10 2008 062 014 A1 6/2010
DE 10 2010 019 959 A1 11/2011
DE 11 2014003 814 T5 5/2016

* cited by examiner

*Primary Examiner* — Audrey K Bradley
(74) *Attorney, Agent, or Firm* — Amster, Rothstein & Ebenstein LLP

(57) ABSTRACT

An assembly for an exhaust system comprises a housing having a jacket, an insert arranged in the interior of the housing and having at least one exhaust pipe, wherein the jacket has an opening, in particular a radial opening, through which the exhaust pipe is connectable to the exhaust system, wherein an adapter part is provided that is connected to the exhaust pipe, and wherein the adapter part has a contact section that contacts the inner side of the jacket around the opening.

19 Claims, 7 Drawing Sheets

ASSEMBLY FOR AN EXHAUST SYSTEM

The present invention relates to an assembly for an exhaust system comprising a housing having a jacket as well as an insert arranged in the interior of the housing and having at least one exhaust pipe. The jacket has an opening, in particular a radial opening, through which the exhaust pipe is connectable to the exhaust system.

The assembly can in particular be a muffler that passively or actively influences the sound characteristic of the exhaust system in a desired manner, e.g. in dependence on a respective load level of the engine.

Such an assembly is as a rule a mass-produced product in light of the large sales figures of motor vehicles whose manufacturing effort, in particular manufacturing costs, should be as low as possible.

The manufacturing effort for the above-named assembly type has already been reduced in part by a modular design in that the insert—as a substantially complete inner structure of the assembly—only has to be pushed into a prefabricated housing element and the housing is then closed. An unwanted manufacturing effort, however, in particular results when the exhaust pipe is to be connected to a connection pipe led from the outside through the opening of the jacket for connection to the exhaust system through the opening of the jacket. The effort is in particular high when the opening extends in parallel with the insertion direction of the insert in the jacket of the housing, i.e. when it is a so-called radial opening. The housing, for example, has a substantially hollow cylindrical jacket (e.g. as a roller housing), with the insert being pushed into the housing or into the jacket at the end face, i.e. in an axial direction. Provided that the exhaust pipe of the insert is to be connected through the radial opening, the exhaust pipe preferably likewise extends in a radial direction at least at the end face, with the opening and the exhaust pipe being aligned when the insert is completely introduced into the housing. The exhaust pipe can only now be connected to a connection pipe introduced at the outside through the opening.

The connection pipe is connected to the exhaust pipe e.g. by welding, with measures having to be taken for protection against welding cinder penetrating into the interior of the housing to avoid damage to the insert on the carrying out of a corresponding welding procedure. Once the connection pipe has been connected to the inwardly disposed exhaust pipe, the respective opening in the jacket has to be closed by a suitable closure piece, with further welding procedures being required to connect the closure piece permanently and durably to the jacket and to the connection pipe. The inwardly disposed exhaust pipe is hereby also supported so that vibrations caused by operation do not excessively strain the mechanical structure of the insert.

It is an object of the invention to further develop the initially named assembly such that the manufacturing effort for the assembly is reduced with respect to the connection of a connection pipe led through an opening of the housing jacket. A corresponding manufacturing method is a further subject of the invention.

The object is satisfied by an assembly having the claimed features and by a method having the claimed steps.

An adapter part that is connected to the exhaust pipe is provided in the assembly in accordance with the invention. The adapter part additionally has a contact section that contacts the inner side of the jacket around the opening.

The adapter part has the advantage that the exhaust pipe is directly mechanically connected to the jacket when the insert is pushed into the housing. A subsequent installation—i.e. after the insert has been pushed into the housing jacket—of a closure part is not necessary. The contact section of the adapter part can in particular act as a ring-shaped flange section by which the exhaust pipe is supported at the jacket. The contact section can be configured as complementary to the inner side of the jacket and can provide an areal, i.e. a mechanically favorable, contact at the jacket, whereby the risk of damage to the jacket, in particular as part of the pushing of the insert into the housing, can be avoided. A support of the exhaust pipe by the adapter part can additionally already be given when the insert is pushed into the housing and the end position has not yet been reached. A mechanical strain acting on the exhaust pipe during the pushing in of the insert can thus be effectively reduced.

The adapter part can be configured in the manner of a stub so that the adapter part establishes an e.g. substantially gas-tight connection between the exhaust pipe and the opening of the jacket, i.e. the interior of the housing is sealed with respect to the outside space and the interior of the exhaust pipe. Separate protective measures against welding cinder penetrating into the interior of the housing can thus e.g. be dispensed with when e.g. a connection pipe led through the opening is to be connected to the exhaust pipe.

The housing can in particular be open at at least one end face in the axial direction to be able to insert the insert into the housing. The housing can then be closed by a suitable cover. It is understood that the opening in question in the jacket (for connection to the exhaust system) does not necessarily have to be a radial opening. The housing can additionally have further openings.

That housing section that forms the hollow space of the housing into which the insert is pushed is to be understood as a jacket within the framework of this disclosure. Its cross-sectional shape can be selected as desired.

An advantage of the solution in accordance with the invention is that the opening in the jacket can be comparatively small. A closure part to be installed from the outside would in contrast require a larger opening. In the solution in accordance with the invention the diameter of the adapter part can e.g. substantially correspond to the diameter of the exhaust pipe or can be slightly larger, whereby the inner space of the housing is used particularly sparingly. The assembly can furthermore be manufactured more efficiently and more reliably overall.

Advantageous embodiments of the invention can be seen from the description, from the dependent claims and from the drawings.

In accordance with an embodiment, the insert is configured such that is can be pushed into the housing. In other words the insert is set back sufficiently far in the radial direction with respect to the inner periphery of the housing, in particular of the jacket, so that the insert can be pushed into the housing without problem. The adapter part and the exhaust pipe are preferably completely arranged in the interior of the housing.

In accordance with a further embodiment, the contact section is connected to the exhaust pipe via an at least sectionally arched or curved connection section of the adapter part. The contact section can hereby be provided with a specific flexibility relative to the exhaust pipe so that the insert can be pushed into the housing without the adapter part canting with the inner side of the jacket and hindering the insertion procedure. It can accordingly also be ensured that tolerances caused by the manufacture do not have a negative effect on the dimensions of the housing or of the insert.

The connection section can be at least sectionally inwardly arched or curved in the direction away from the jacket. This can in particular be advantageous if sufficient space is to be created to connect the connection pipe to the exhaust pipe.

Alternatively or additionally to the inward arching or curvature, the connection section can be at least sectionally outwardly arched or curved in the direction toward the jacket. This solution can e.g. be pursued in order to use as little space as possible in the inner space of the housing.

For example, the connection section can first extend radially inwardly, starting from the end of the exhaust pipe, and can then be bent over in the direction of the jacket. This additionally has the advantage that the connection pipe can engage around the connection section and/or the connection section can engage around the exhaust pipe.

It is understood that an arching or curvature of the connection section does not necessarily have to be rounded or steady. Kink points are thus in particular also covered by "arching" or "curvature".

In accordance with a further embodiment, the contact section is provided with a chamfer at its side remote from the exhaust pipe. For example, a respective margin of the contact section is at least slightly inwardly bent away from the jacket so that the latter is not damaged by a possible sharp-edged margin of the system section. The chamfer can furthermore serve to facilitate the insertion of the insert in that a stubborn "scratching along" of the contact section at the jacket is avoided. The chamfer can in particular be provided along an outer peripheral contour of the contact section, in particular section-wise transversely to a direction of insertion of the insert.

The contact section can at least sectionally be connected to the jacket with material continuity, in particular by spot welding. The durability and stability of the assembly can thus be substantially increased. The contact section can in particular be thicker than the jacket. The connection with material continuity can hereby be implemented particularly advantageously, with the risk of an unwanted "exhaust gas leak" being reduced.

The adapter part can be plugged onto the exhaust pipe. In this respect, the connection section of the adapter part can sectionally form a stub that either engages around the end of the exhaust pipe or engages into the exhaust pipe at the inner side. In addition to this plug-in connection, the adapter part, in particular the connection section, can be at least sectionally connected to the exhaust pipe with material continuity, preferably by spot welding, whereby the connection is also reliably maintained under mechanical vibrations and thermal strains.

In accordance with a further embodiment, the exhaust pipe and/or the connection section can comprise a connector section for a connection pipe led from the outside through the opening of the jacket. The connector section can in particular be formed in common by the exhaust pipe and the connection section. The connection pipe can project sectionally into the exhaust pipe or can be arranged between the exhaust pipe and the connection section. Alternatively, the connection pipe can sectionally engage around both the exhaust pipe and the connection section. The exhaust pipe and the connection section can generally overlap, with the connector section for the connection pipe preferably being formed in the overlap region in this case. The connector section can hereby have a particular stability for the connection pipe, which also benefits the overall stability of the assembly. It must be named as a further advantage that a connection with material continuity of the exhaust pipe, of the connection section, and of the connection pipe can be carried out by a single welding procedure, e.g. as a triple-layer weld seam. The manufacture can thus be designed particularly simply under this aspect.

The invention additionally relates to a method of manufacturing an assembly for an exhaust system, in particular an assembly in accordance with the teaching presented herein, wherein the assembly comprises a housing having a jacket and comprises an insert arranged in the housing. The jacket has an opening, in particular a radial opening, for the connection of the exhaust pipe to the exhaust system. The insert comprises at least one exhaust pipe and an adapter part that is connected to the exhaust pipe. The insert is inserted into the housing, in particular pushed into the jacket, so that a contact section of the adapter part comes to contact the inner side of the jacket around the opening and a connection between the opening and the exhaust pipe is established by the adapter part.

In accordance with a preferred embodiment, the contact section is connected to the jacket with material continuity, in particular by spot welding. A connection pipe can furthermore be led from the outside through the opening and can be connected to a connector section of the assembly so that a connection, in particular a gas-tight connection, is established between the connection pipe and the exhaust pipe. The exhaust pipe, the adapter part and the connection pipe can in this respect be connected to one another with material continuity, in particular by spot welding.

The invention will be explained only by way of example in the following with reference to the drawings in which.

Parts that are the same or similar are provided with the same reference numerals in the Figures.

Figure 1:
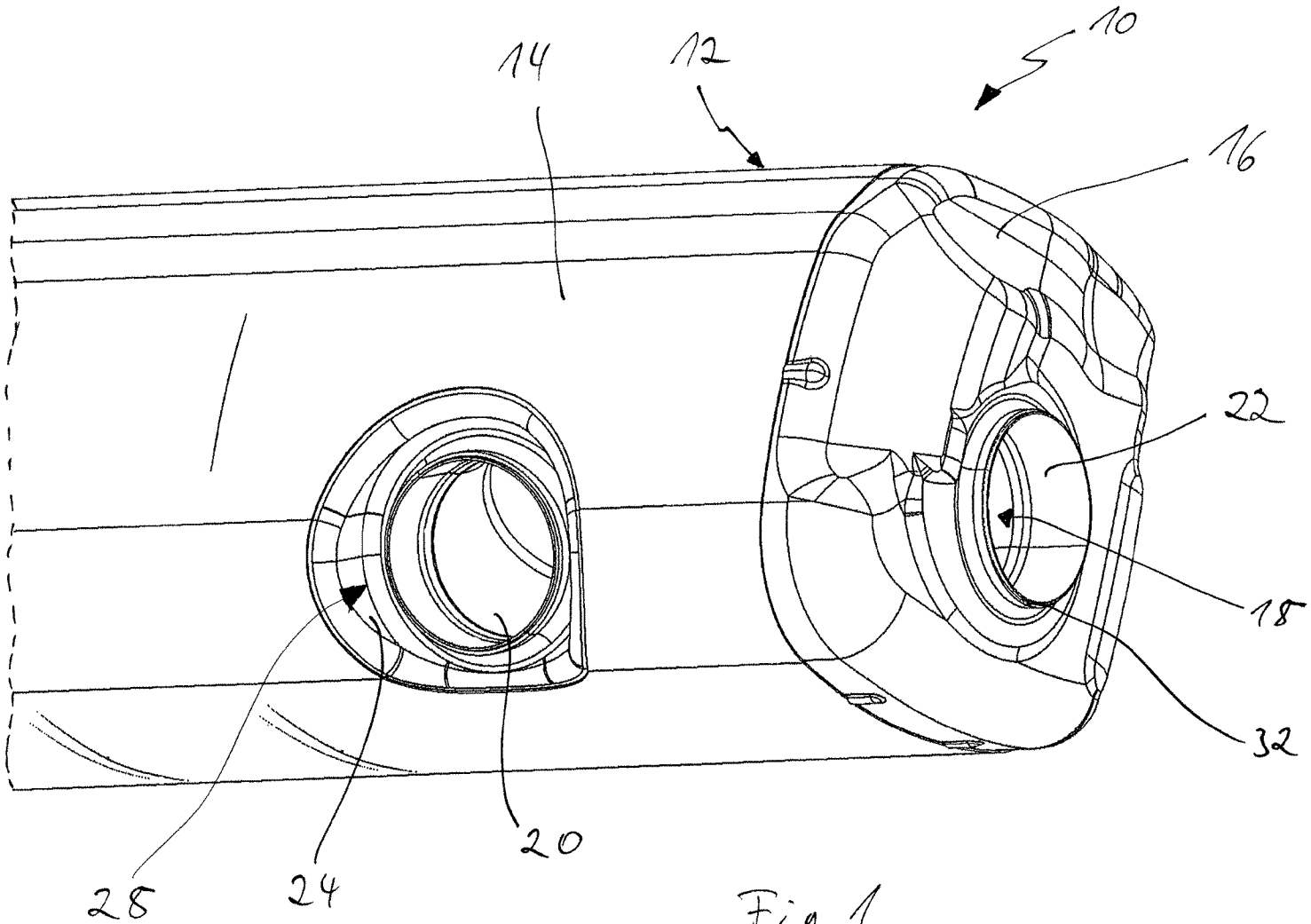
FIG. 1 shows a perspective view of an assembly in accordance with the invention.
Figure 2:
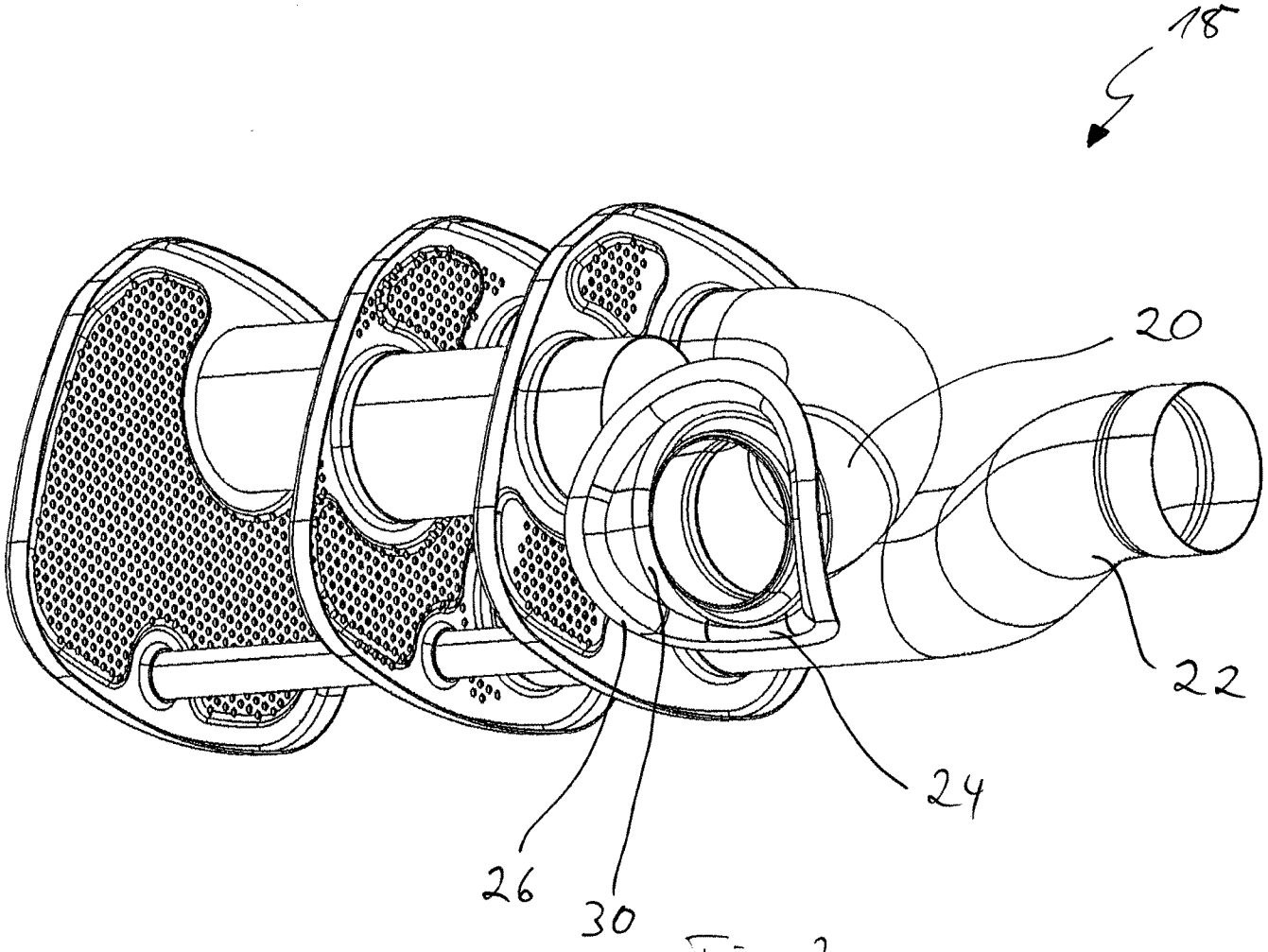
FIG. 2 shows a perspective view of an insert of the assembly of FIG. 1.
Figure 3:
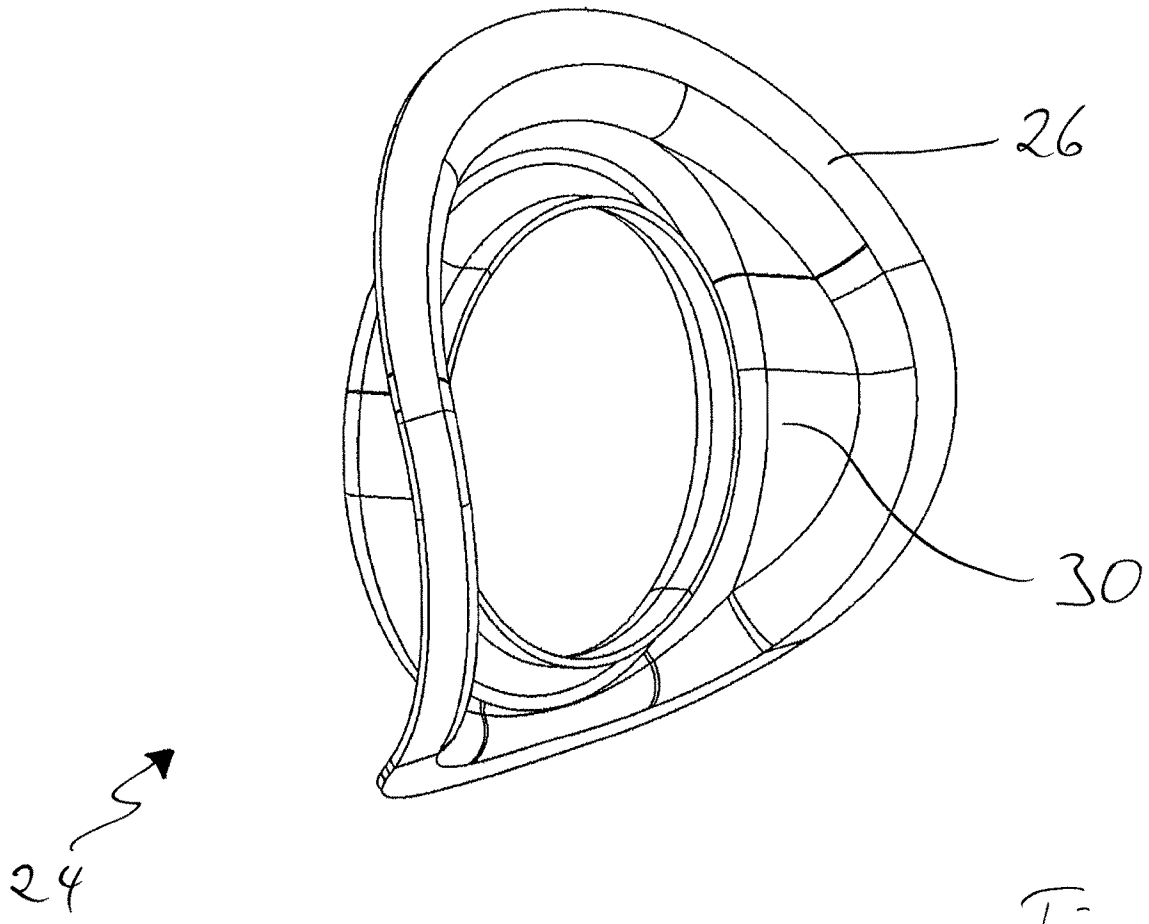
FIG. 3 shows a perspective view of an adapter part of the insert of FIG. 2.
Figure 5:
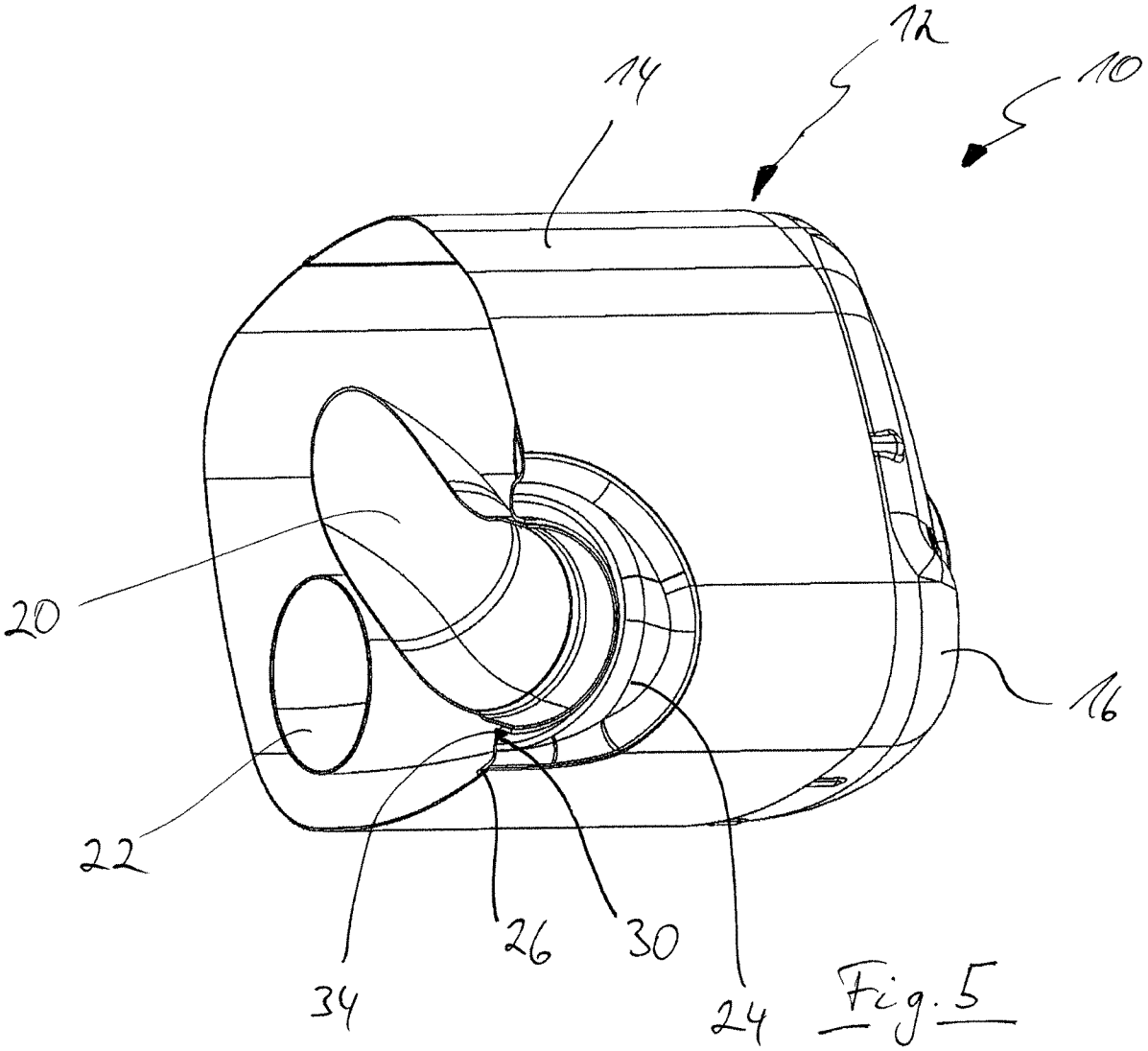
FIG. 5 shows a cross-sectional perspective view of the assembly of FIG. 1.
Figure 6:
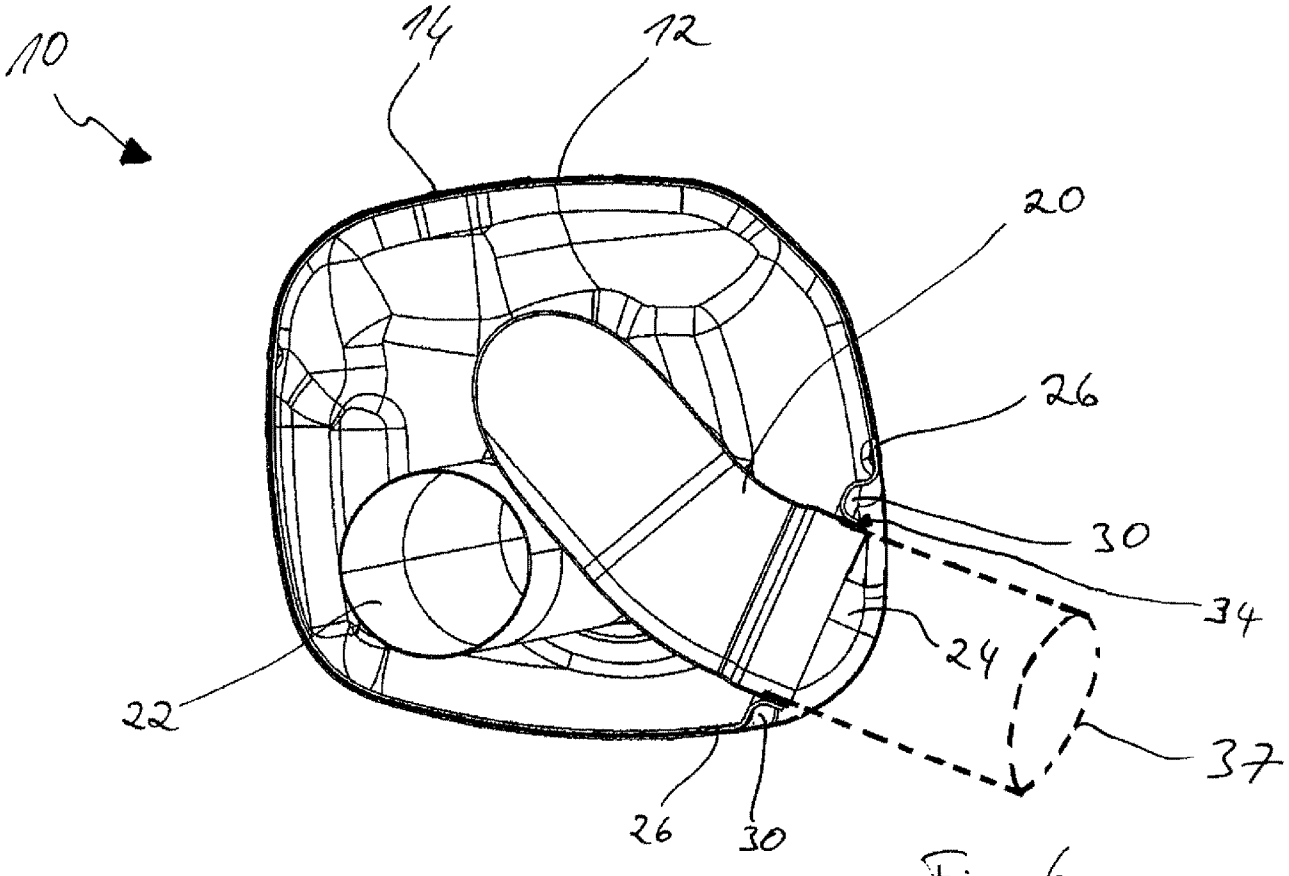
FIG. 6 shows a cross-sectional perspective view of the assembly of FIG. 5.

An assembly 10, here specifically a muffler by way of example, for an exhaust system, not shown, is shown in FIG. 1. The assembly 10 is only partly shown in FIG. 1, with the assembly 10 continuing at the left side. The assembly 10 comprises a closed housing 12 that comprises a jacket 14 and at least one end-face cover 16. An insert, not shown in any more detail in FIG. 2, is arranged in the housing 12 and has two exhaust pipes 20 and 22 that can e.g. act as an inlet pipe or an outlet pipe. The exhaust pipe 20 extends at the end face in the radial direction of the housing 12. The exhaust pipe 22 in contrast extends in the axial direction at the end face. The (radial) exhaust pipe 20 is connected at the end face to an adapter part 24 that is shown enlarged in FIG. 3. The adapter part 24 has a ring-shaped contact section 26 that is configured complementary to the shape of the jacket 14, that contacts the inner side of the jacket 14 around an opening 28 of the jacket 14 and is connected with material continuity and in a gas-tight manner to the jacket 14 by spot welding. The areal contact of the contact section 26 at the inner side of the jacket 14 can in particular be seen from FIGS. 5 and 6. The contact section 26 is integrally connected to a connection section 30 that extends between the exhaust pipe 20 and the contact section 26. The connection section 30 is sectionally inwardly arched away from the jacket 14 and is bent over in the radial direction in the region of the exhaust pipe 20 so that the connection section 30 engages around the exhaust pipe 20 at the end face or forms a plug-in connection nose for the exhaust pipe 20. The connection section 30 is additionally connected, in particular by spot welding, to the exhaust pipe 20 with material continuity and in a gas-tight manner.

The (axial) exhaust pipe 22 that extends in the axial direction at the end face engages into an opening 32 of the cover 16 (cf. FIG. 1), with no adapter part being provided. In accordance with the invention, however, an adapter part could also be provided for the exhaust pipe 22.

Figure 4:
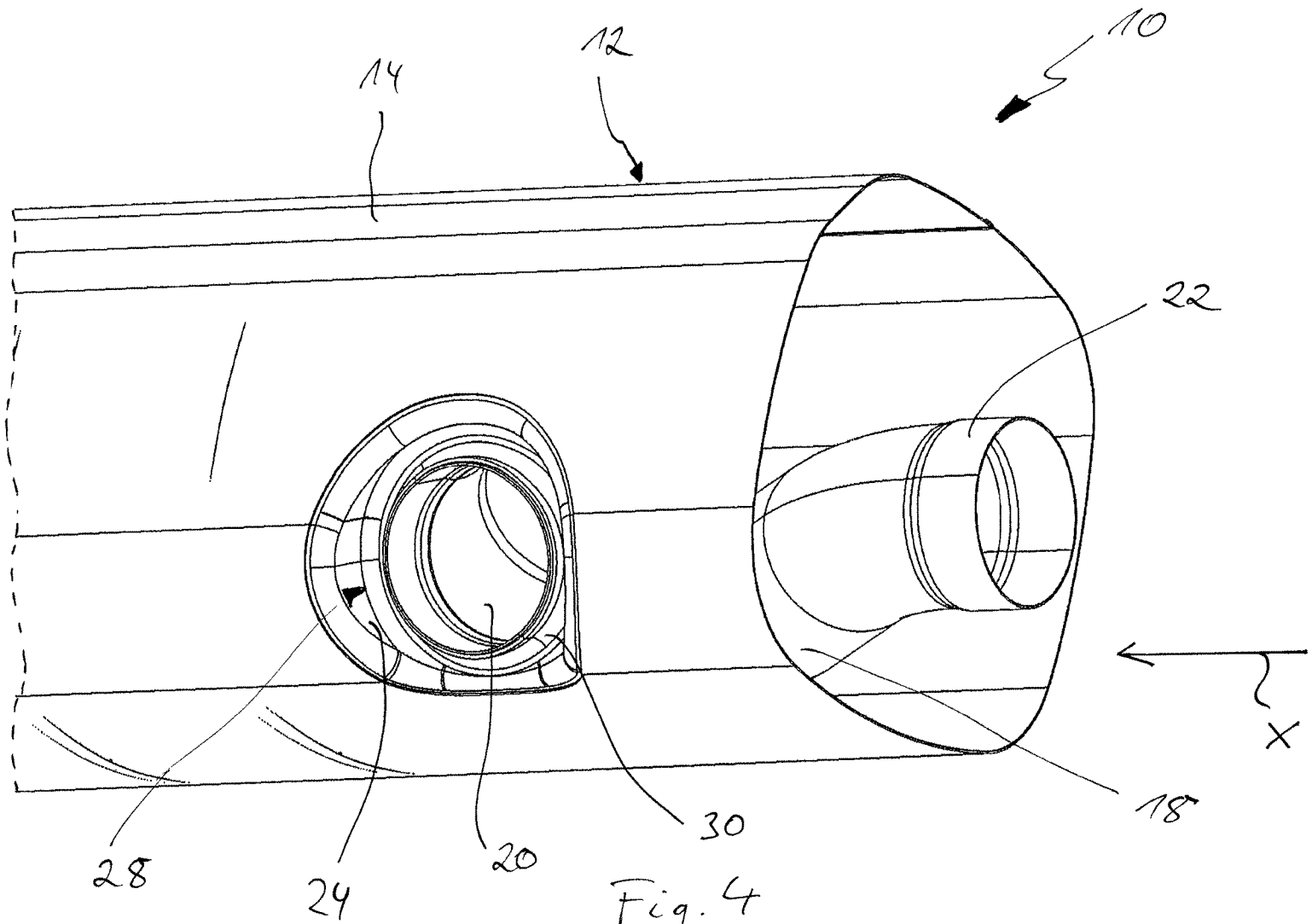
FIG. 4 shows a perspective view of the assembly of FIG. 1 with a housing open at the end face.

The assembly 10 is preferably installed such that the insert 18 of FIG. 2 is pushed laterally into the jacket 14 of the housing 12 in the axial direction X until the radial exhaust pipe 20 with the adapter part 24 is in alignment—as shown in FIG. 4—with the radial opening 28 of the jacket 14. The contact section 26 that already areally contacts the inner side of the jacket 14 around the opening 28 can hereby be connected, e.g. by spot welding, to the jacket 14. The jacket 14 can subsequently be closed by the cover 16 at the end face so that the assembly 10 shown in FIG. 1 results.

The radial exhaust pipe 20 and the connection section 30 form a stable connector section 34 for a connection pipe 37 (cf. FIGS. 5 and 6) in their overlap region. The connection pipe 37 can either engage around the connector section 34 or can be plugged into the exhaust pipe 20 (it can be recognized in FIGS. 5 and 6 that the end section of the pipe 20 is a little widened for this purpose) so that the connection section 34 engages around the connection pipe. As a result, a triple-layer overlap region is present in both cases that results in a connection with material continuity of the components 20, 24 to one another and to the connection pipe 37 with a single welding procedure. Alternatively, the connection section 30 can, as mentioned above, first be connected to the exhaust pipe 20 with material continuity, with the connection pipe 37 subsequently being separately connected either to the connection section 30 or to the exhaust pipe 22.

Figure 7:
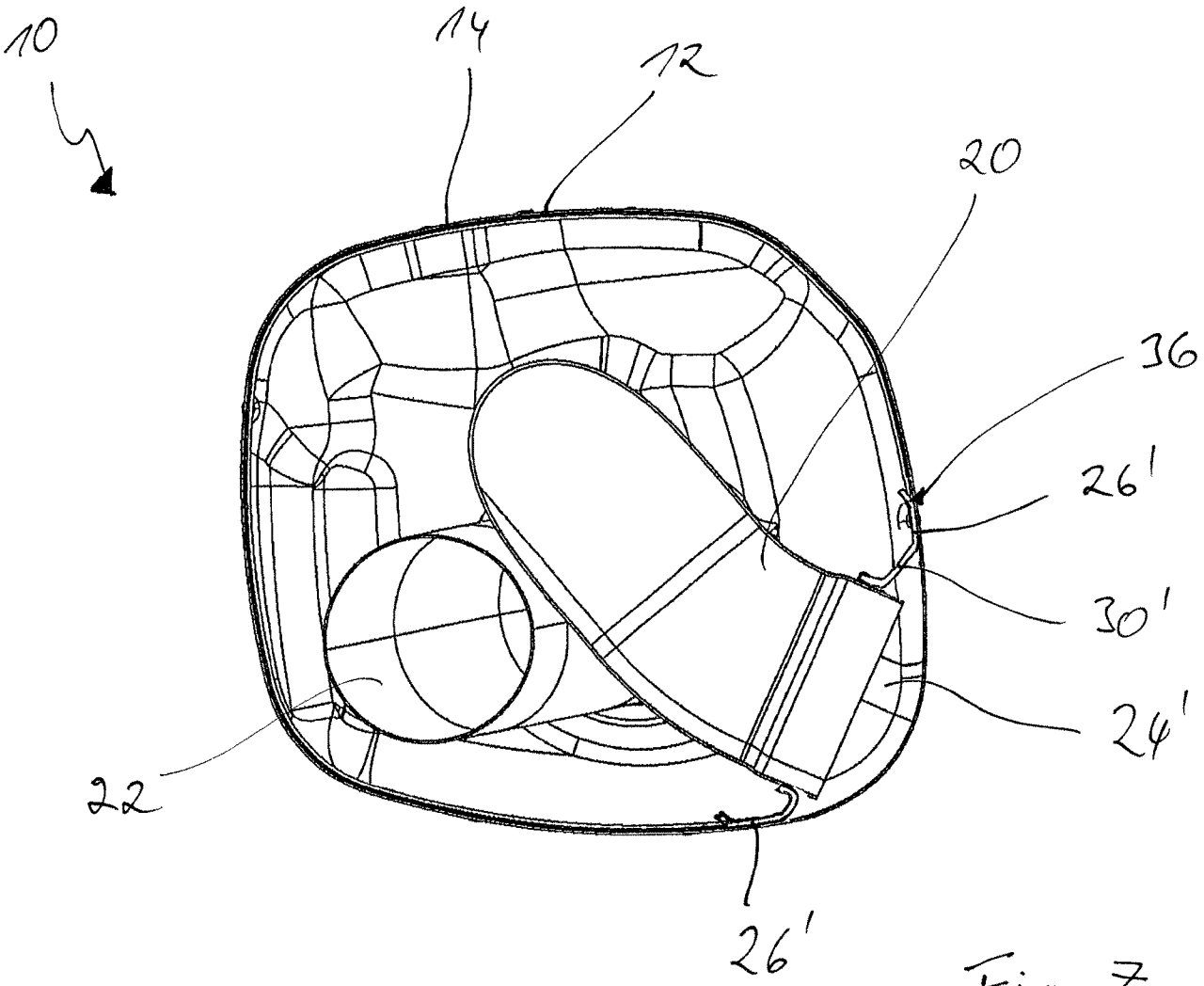
FIG. 7 shows a cross-sectional view of a further embodiment of the assembly in accordance with the invention.

The assembly 10 is shown in an alternative embodiment in FIG. 7 in which a different adapter part 24' is installed. On the one hand, the contact section 26' is bent inwardly away from the jacket 14 at the marginal side so that a chamfer 36 results that facilitates the pushing in of the insert 18 and prevents damage to the jacket 14. On the other hand, the connection section 34 is outwardly curved in the direction of the jacket 14, starting from the exhaust pipe 20. The support effect of the adapter part 24' for the exhaust pipe 20 can hereby be improved, with less space simultaneously being taken up in the interior of the jacket 14 than with the adapter part 24 of FIG. 3.

It is understood that individual features of the adapter parts 24 and 24' can be combined with one another in line with demands. For example, the chamfer 36 can also be provided in the adapter part 24. The connection section 30 can furthermore be differently curved sectionally so that it combines the advantages of both variants in the best possible manner.

REFERENCE NUMERAL LIST

10 assembly
12 housing
14 jacket
16 cover
18 insert
20 exhaust pipe
22 exhaust pipe
24, 24' adapter part
26, 26' contact section
28 opening
30 connection section
32 opening
34 connector section
36 chamfer

The invention claimed is:

1. An assembly for an exhaust system, the assembly comprising:

a housing having a jacket;

an insert arranged in an interior of the housing and having at least one exhaust pipe, wherein the jacket has an opening through which the exhaust pipe is connectable to the exhaust system; and an adapter part that is connected to the exhaust pipe, wherein the adapter part has a contact section that contacts an inner side of the jacket around the opening, and the adapter part and the exhaust pipe are completely arranged in the interior of the housing.

2. The assembly in accordance with claim 1, wherein the opening is a radial opening.

3. The assembly in accordance with claim 1, wherein the contact section is provided with a chamfer at its side remote from the exhaust pipe.

4. The assembly in accordance with claim 1, wherein the contact section is at least sectionally connected to the jacket with material continuity.

5. The assembly in accordance with claim 1, wherein the contact section is at least sectionally connected to the jacket with material continuity by spot welding.

6. The assembly in accordance with claim 1, wherein the adapter part is plugged onto the exhaust pipe.

7. The assembly in accordance with claim 1, wherein the insert is configured such that it can be inserted into the housing.

8. The assembly in accordance with claim 7, wherein the insert is configured such that it can be pushed into the jacket.

9. The assembly in accordance with claim 1, wherein the contact section is connected to the exhaust pipe via an at least sectionally arched or curved connection section of the adapter part.

10. The assembly in accordance with claim 9, wherein the connection section is at least sectionally inwardly arched or curved in a direction away from the jacket.

11. The assembly in accordance with claim 9, wherein the connection section is at least sectionally outwardly arched or curved in a direction toward the jacket.

12. The assembly in accordance with claim 9, wherein the connection section is connected to the exhaust pipe at least sectionally with material continuity.

13. The assembly in accordance with claim 9, wherein the connection section is connected to the exhaust pipe at least sectionally with material continuity by spot welding.

14. The assembly in accordance with claim 9, wherein at least one of the exhaust pipe and the connection section comprises a connector section for a connection pipe led from the outside through the opening of the jacket.

15. The assembly in accordance with claim 14, wherein the exhaust pipe and the connection section overlap, with the connector section for the connection pipe being formed in the overlap region.

16. A method of manufacturing an assembly for an exhaust system comprising a housing having a jacket and an insert having at least one exhaust pipe, the jacket having an opening for the connection of the exhaust pipe to the exhaust system, the method comprising:

connecting the exhaust pipe to an adapter part; and inserting the insert into the housing such that the adapter part and the exhaust pipe are completely arranged within an interior of the housing, so that a contact section of the adapter part comes to contact an inner side of the jacket around the opening and a connection between the opening and the exhaust pipe is established by the adapter part.

17. The method in accordance with claim 16, wherein the contact section is connected to the jacket with material continuity.

18. The method in accordance with claim 16, wherein a connection pipe is led from the outside through the opening and is connected to a connector section of the assembly so that a connection is established between the connection pipe and the exhaust pipe.

19. The method in accordance with claim 18, wherein the exhaust pipe, the adapter part and the connection pipe are connected to one another with material continuity.

* * * * *